US006892515B2

(12) United States Patent
Cere'

(10) Patent No.: US 6,892,515 B2
(45) Date of Patent: May 17, 2005

(54) APPARATUS FOR BANDING GROUPS OF PALLETISED PRODUCTS

(75) Inventor: Mauro Cere', Loiano (IT)

(73) Assignee: Aetna Group, S.p.A., Rimini (IT)

( * ) Notice: Subject to any disclaimer, the term of this patent is extended or adjusted under 35 U.S.C. 154(b) by 0 days.

(21) Appl. No.: 10/417,698

(22) Filed: Apr. 17, 2003

(65) Prior Publication Data

US 2003/0200730 A1 Oct. 30, 2003

(30) Foreign Application Priority Data

Apr. 24, 2002 (IT) ..... BO2002A0232

(51) Int. Cl.[7] ..... B65B 11/00

(52) U.S. Cl. ..... 53/586; 53/228; 53/53; 53/374; 53/556

(58) Field of Search ..... 53/580, 228, 53, 53/374 S, 556

(56) References Cited

U.S. PATENT DOCUMENTS

| | | | | | |
|---|---|---|---|---|---|
| 3,672,116 | A | * | 6/1972 | Ingmarson | 53/397 |
| 4,044,529 | A | * | 8/1977 | Zelnick | 53/548 |
| 4,409,776 | A | * | 10/1983 | Usui | 53/399 |
| 4,413,463 | A | * | 11/1983 | Lancaster | 53/399 |
| 4,499,706 | A | * | 2/1985 | Scheller | 53/399 |
| 4,628,668 | A | * | 12/1986 | Wildmoser | 53/399 |
| 4,831,812 | A | * | 5/1989 | Martin Cocher et al. | 53/399 |
| 4,905,448 | A | * | 3/1990 | Plitt | 53/399 |
| 4,914,892 | A | * | 4/1990 | Saito et al. | 53/399 |
| 5,067,312 | A | * | 11/1991 | Van Dijk | 53/556 |
| 5,129,211 | A | * | 7/1992 | Andersson | 53/399 |
| 5,787,681 | A | * | 8/1998 | Papina et al. | 53/373.7 |
| 6,474,051 | B1 | * | 11/2002 | Hannen et al. | 53/586 |

FOREIGN PATENT DOCUMENTS

| | | |
|---|---|---|
| EP | 0 183 676 | 6/1986 |
| EP | 1 029 786 | 8/2000 |

OTHER PUBLICATIONS

European Search Report dated Jun. 24, 2004 corresponding to Application No. EP 03 42 5246.

* cited by examiner

*Primary Examiner*—John Sipos
*Assistant Examiner*—Michelle Lopez
(74) *Attorney, Agent, or Firm*—Fay, Sharpe, Fagan, Minnich & McKee, LLP

(57) ABSTRACT

An apparatus (1) for banding palletized products comprises: a conveyor (2), extending in a direction of feed (A), for transporting pallets (3), each bearing a stack (4) of products; a gantry structure (5) mounted over the conveyor (2) and equipped with two pairs (6, 7) of film reels, each pair being mounted at a different height from the other on the gantry uprights (5*a*, 5*b*) in such a way as to form two bands (8, 9) of film positioned transversely relative to the uprights (5*a*, 5*b*) so as to intercept the front of the product stack (4) as it moves forward; a pair of units (10, 11) for sealing and cutting the film bands (8, 9) supported by the gantry structure (5) on the rear side of the latter relative to the direction of feed (A), and mobile between an idle position, where the units (10, 11) are close to the uprights (5*a*, 5*b*), and a working position, where the units (10, 11) are away from the uprights (5*a*, 5*b*) so that each intercepts, seals and cuts a respective portion of the film bands (8, 9) wrapped around the product stack (4); the pair of sealing and cutting units (10, 11) being supported also by a single mounting unit (12) that projects from the gantry structure (5) and that slides along the crossbeam (5*c*) of the latter to and from the idle and working positions.

12 Claims, 4 Drawing Sheets

APPARATUS FOR BANDING GROUPS OF PALLETISED PRODUCTS

BACKGROUND OF THE INVENTION

The present invention relates to an apparatus for banding groups of palletized products, in particular palletized loads consisting of stacked products (such as, for example, but not restricted to, packs of bottles or other containers) to undergo intermediate processes and to be transported from one factory to another or from one processing station to another).

Apparatus of this type is used to wrap a band of material around a group of palletized products stacked to a certain height and relatively light in weight, in such a way as to stabilize the stack during its transportation from one processing line to another. The palletized load might consist, for example, of bottle crates placed side by side and stacked in two or more layers.

To stabilize a load of this type, the banding apparatus wraps a first band of plastic film at a certain height in order to hold the stack together at the most unstable part of it which would be the first to topple during transportation.

Prior art machines that perform banding operations this type comprise a gantry structure whose uprights mount a pair of film reels at a predetermined height. The film is unwound by suitable rollers in such a way that it is positioned transversely between the uprights to intercept the palletized load as the pallet moves under the gantry structure on a conveyor.

The forward motion of the pallet, after its front end has come into contact with the band of film, causes the reels to unwind so as to wrap the band around the sides of the products stacked on the pallet. As soon as the pallet has moved past the gantry, it is stopped and a unit comprising a sealer and a cutter, mounted behind the uprights, runs along the back of the pallet on suitable supports in a direction parallel to the rear face of the palletized load in such a way that the band of film is wrapped right around the palletized load. In other words, the film forms a loop around the upper section of the palletized product load and, since the film used is usually stretch film, also has a tightening effect which holds the load together.

At this point, the section of the band at the back of the palletized load is sealed and, as soon as this has been done, the cutter cuts the band half way between the two sealed ends: that means the looped band wrapped around the palletized load is closed, sealed and cut off, while the seal keeps the two reels joined to each other by the remaining film positioned transversely between the two uprights and ready to intercept the next palletized load moving forward on the conveyor.

At present, an increasingly frequent requirement is for banding machines to apply to the palletized load a second band of film, lower down than the first and bearing a distinguishing mark, such as a label identifying the products transported or their factory of origin.

To make applications of this type possible, the following have been added to banding machines:

a pair of reels mounted on the uprights of the gantry structure and designed to wrap a second band of plastic film, to which labels can be applied, at a fixed height relative to the uprights themselves; and a second sealer and cutter assembly similar to the first assembly, and independent of it, mounted close to the base of the gantry structure and mobile in synchrony with the first assembly by means of two additional arms, designed to seal and cut the second band in the same way as the first.

This type of solution consists basically of a machine already well known in the trade with the simple addition of another pair of film reels and a second, fixed, independent unit but without adapting its constructional philosophy to suit the new requirement.

As a result, machines of this type are rather cumbersome, and adjusting the working heights of the sealing and cutting units is, at best, a highly complex operation (precisely because the units are independent of each other), which means that changeover down times have increased significantly).

Moreover, the second sealing unit at the bottom might be obstructed and unable to perform its work properly since existing pallet conveyors vary in height and in some cases cover the bottom section of the gantry structure that houses the second sealing unit.

The present invention has for an object to overcome the above mentioned disadvantages by providing an apparatus for banding palletized products that has a very compact structure, with sealing and cutting units which are quick and easy to adjust, that is adaptable to any conveyor and that operates in highly synchronized fashion.

SUMMARY OF THE INVENTION

This object is achieved in an apparatus for banding palletized products that comprises: a conveyor, extending in a direction of feed, for transporting pallets, each bearing a stack of products; a gantry structure mounted over the conveyor and equipped with two pairs of film reels, each pair being mounted at a different height from the other on the gantry uprights in such a way as to form two bands of film positioned transversely relative to the uprights so as to intercept the front of the stack of products as it moves forward; a pair of units for sealing and cutting the film bands, supported by the gantry structure on the rear side of the latter relative to the direction of feed, and mobile between an idle position, where the units are close to the uprights, and a working position, where the units are away from the uprights so that each intercepts, seals and cuts a respective portion of the film bands wrapped around the product stack; the pair of sealing and cutting units being supported also by a single mounting unit that projects from the gantry structure and that slides along the crossbeam of the latter to and from the idle and working positions.

BRIEF DESCRIPTION OF THE DRAWINGS

The technical characteristics of the invention, with reference to the above aims, are clearly described in the claims below and its advantages are apparent from the detailed description which follows, with reference to the accompanying drawings which illustrate a preferred embodiment of the invention provided merely by way of example without restricting the scope of the inventive concept, and in which:

DESCRIPTION OF THE PREFERRED EMBODIMENTS

Figure 1:
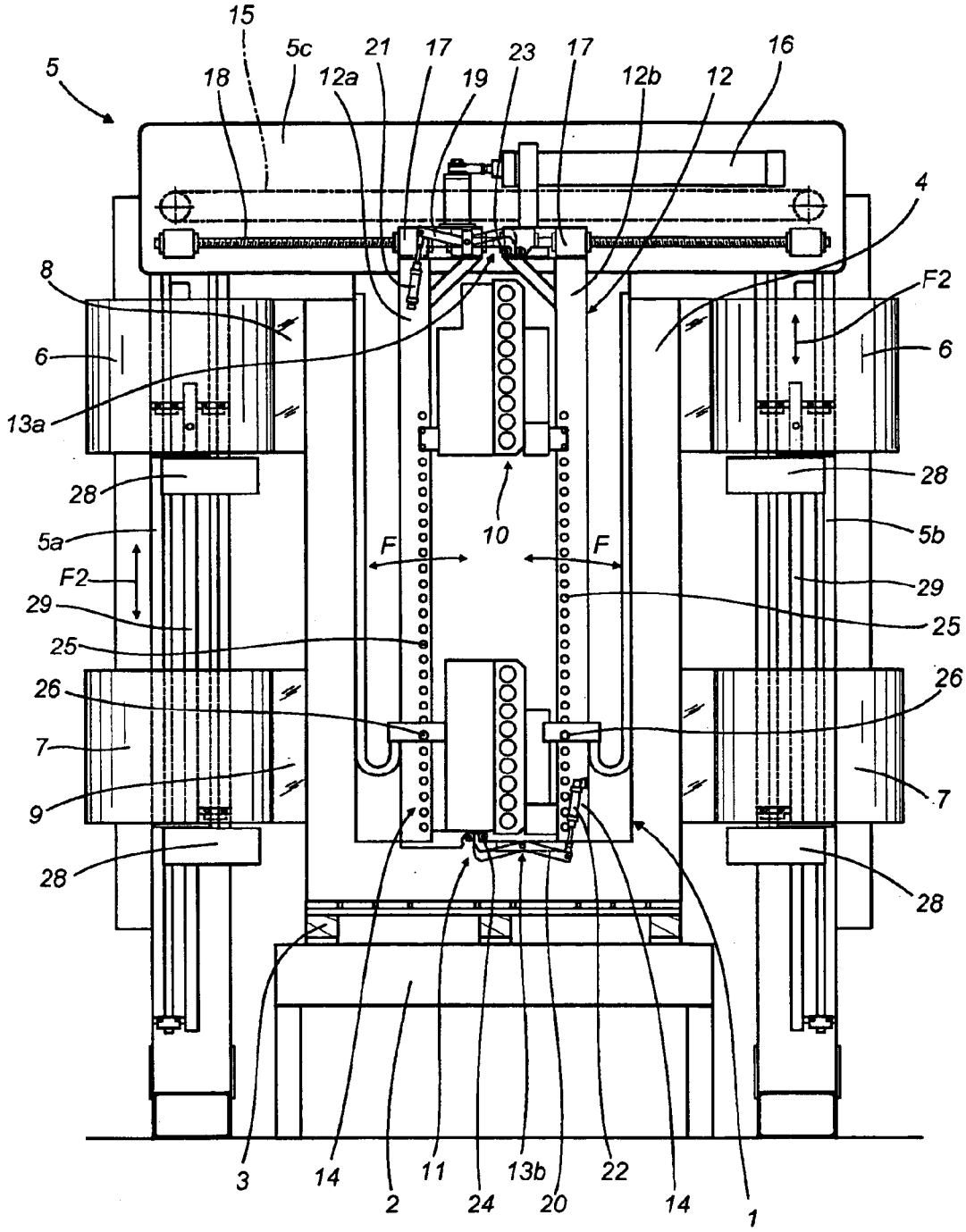
FIG. 1 is a schematic front view, with some parts cut away to better illustrate others, of an apparatus for banding palletized products according to the present invention.
Figure 2:
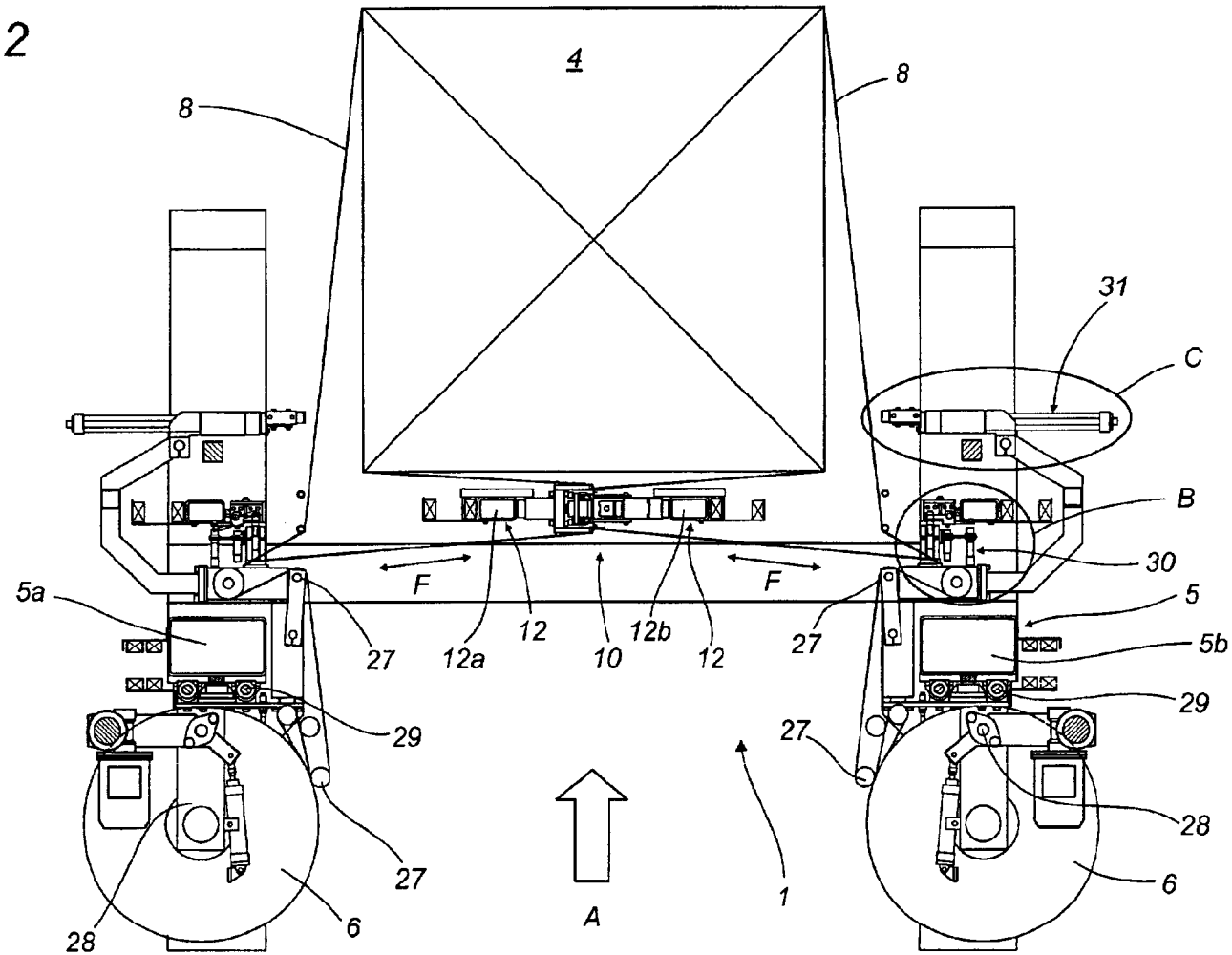
FIG. 2 is a top plan view, with some parts cut away in order to better illustrate others, of the apparatus of FIG. 1.

With reference to the accompanying drawings, in particular FIGS. 1 and 2, the apparatus according to the invention is used to band palletized products.

More specifically, the apparatus is used for pallets bearing stacked products which have to undergo intermediate processes and must therefore be transported from one factory to another or from one processing station to another.

For example, and without restricting the scope of the invention, the apparatus is used for banding palletized loads which consist of bottle crates placed side by side and stacked in two or more layers and which necessitate a band of film to stabilize them at the top, and another band of film bearing an identification label at the bottom.

The apparatus, denoted in its entirety by the numeral 1, comprises a conveyor 2, a gantry structure 5 and a pair of sealing and cutting units 10 and 11.

More specifically, the conveyor 2 may consist of a roller conveyor or a conveyor belt extending in a direction of feed A and used to carry the pallets 3, each supporting a stack 4 of the aforementioned products.

The gantry structure 5 is mounted over the conveyor 2 and is equipped with two pairs 6 and 7 of film reels, each pair being mounted at a different height from the other on the uprights 5*a* and 5*b* of the gantry structure 5.

The pairs of film reels 6 and 7 are mounted in such a way as to form two bands of film 8 and 9 positioned transversely relative to the uprights 5*a* and 5*b* so as to intercept the front of the product stack 4 as it moves forward.

The units 10 and 11 for sealing and cutting the bands of film 8 and 9 are mounted by the gantry structure 5 on the rear side of the latter relative to the direction of feed A and are mobile between:

an idle position, where the units 10 and 11 are close to the uprights 5*a* and 5*b* (as shown in FIG. 2); and a working position, where the units 10 and 11 are away from the uprights 5*a* and 5*b* so that each intercepts, seals and cuts a respective portion of the film bands 8 and 9 wrapped around the product stack 4 (as shown in FIG. 1.

Still with reference to FIG. 1, the sealing and cutting units 10 and 11 are supported by a single mounting unit 12 that projects from the gantry structure 5 and that slides along the crossbeam 5*c* of the latter to and from the idle and working positions (as indicated by the arrows F in FIGS. 1 and 2).

The mounting beam 12 comprises a pair of vertical bars 12*a* and 12*b* mounted on and projecting from the crossbeam 5*c* and supporting the pair of units 10 and 11 associated with the bars 12*a* and 12*b*.

As shown in FIGS. 1 and 2, each unit 10 and 11 is divided into two halves, each attached to one of the beams 12*a* and 12*b*. The units 10 and 11 comprise hot sealers and knives which, respectively, seal each band of film at two points and cut it between the two sealed points in such a way as to close the loops formed by the bands of film wrapped around the stack 4 and join the bands extending between the uprights 5*a* and 5*b* so they are ready to intercept the next pallet. The units will not be described in further detail as they are well within the knowledge of an expert in the trade.

The bars 12*a* and 12*b* are driven to and from the idle and working positions by a drive system located on the crossbeam 5*c*.

As shown in FIG. 1, one of the bars 12*a* and 12*b* is linked to a section of an endless chain 15 supported by the crossbeam 5*c*. The chain 15 is driven by a cylinder 16 that acts on the other section of the chain 15 in such a way as to drive the units 10 and 11 in both directions (see arrow F).

Each of the bars 12*a* and 12*b* has a bearing 17 that joins it to a single horizontal worm screw 18 located on the crossbeam 5*c*: this makes it possible to synchronize the movements of the two bars 12*a* and 12*b* towards and away from each other under the action of the cylinder 16.

The pair of bars 12*a* and 12*b* is equipped with locking means 13*a*, 13*b* acting on the ends of the bars 12*a* and 12*b* themselves when they are at the working position, thus forming a rigid system.

More specifically, the locking means 13*a*, 13*b* consist of a pair of bolts 19 and 20 pivoted at the top and bottom ends of one of the bars 12*a* and 12*b*.

Each bolt is driven by a cylinder 21 and 22 that drives it between a raised idle position (shown by the continuous line in FIG. 1) and a lowered working position at which each bolt 19 and 20 engages a corresponding pin 23 and 24 located on the other bar 12*a* and 12*b*: this stabilizes the bars 12*a* and 12*b* along their full length when they are in the working position.

The bars 12*a* and 12*b* are also equipped with means 14 for adjusting the position of each of the units 10 and 11 lengthwise along the bars according to the positions of the respective reels 6 and 7.

Looking in more detail, the means 14 for separately adjusting the sealing and cutting units 10 and 11 along each bar 12*a* and 12*b* consist of a plurality of holes 25 equally spaced on each of the bars 12*a* and 12*b* and engaged with a mobile pin 26 presented by each sealing and cutting unit 10 and 11.

The reels 6 and 7 are mounted on the uprights 5*a* and 5*b* and are equipped with rollers 27 for feeding and tensioning the bands of film 8 and 9 being unwound so as to keep the bands of film properly tensioned when they are intercepted by the product stack 4.

Each of the reels 6 and 7 also has a carriage 28 coupled to a power driven worm screw shaft 29 that enables adjustment in both directions along the respective upright 5*a* and 5*b* (see arrows F2).

Figure 3:
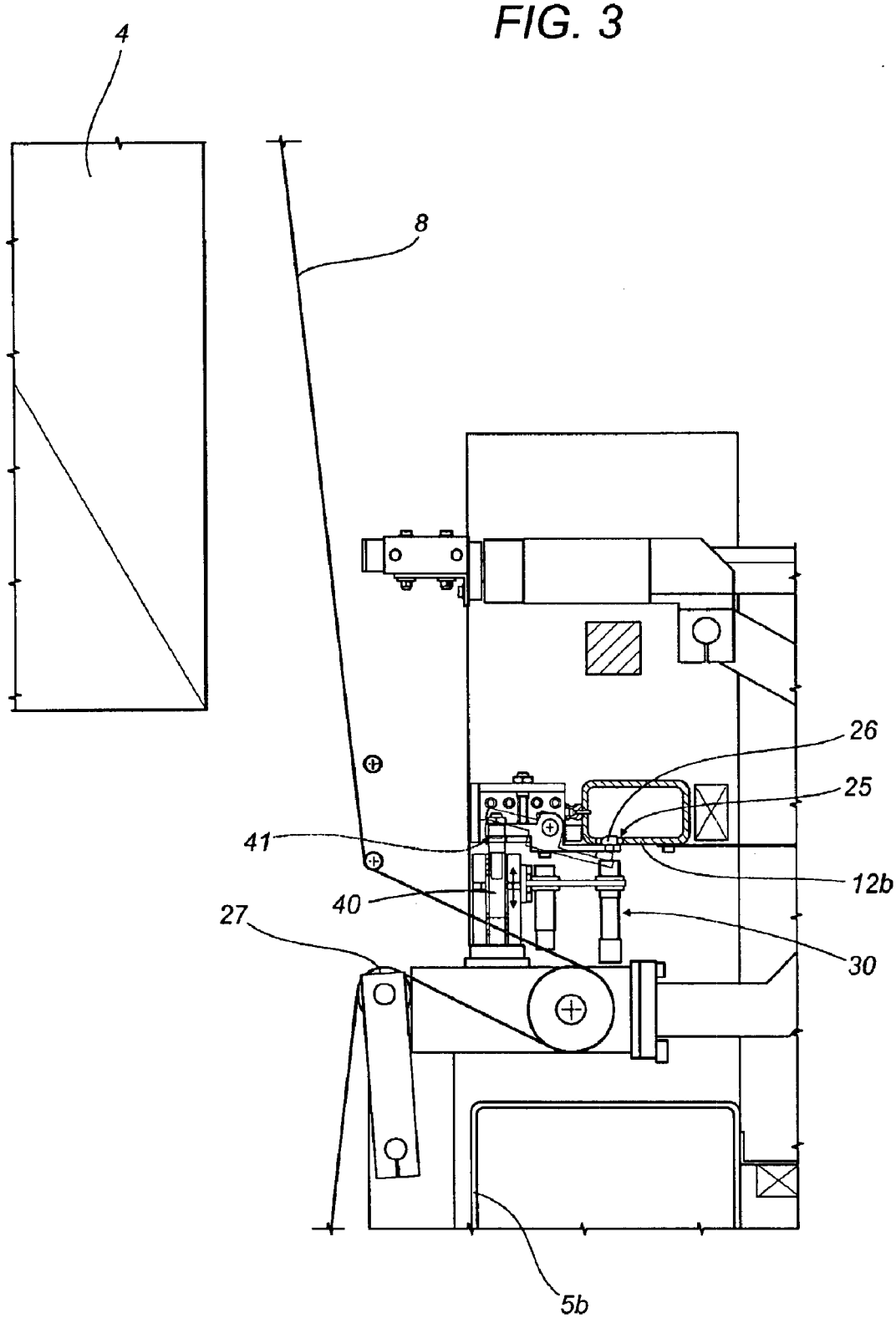
FIG. 3 is a top plan view showing an enlarged detail B from FIG. 2.

As shown in FIGS. 2 and 3, between the reels 6 and 7 and the respective sealing and cutting unit 10 and 11, there are means 30 for synchronizing the movements of the reels 6 and 7 with those of the corresponding sealing and cutting units 10 and 11 during their adjustment in height when the bars 12*a* and 12*b* are in the idle position.

For example, but without restricting the scope of the invention, the means 30 may consist of a coupling pin 40 connected to the mounting carriage 28 of each reel 6 and 7 and designed to be inserted into corresponding cavity 41 in the units 10 and 11 when the latter are in the idle position.

When the pin 40 engages with the cavity 41, the mobile pin 26 may be released from the respective bar 12*a* and 12*b* to allow the reels 6 and 7 and the units 10 and 11 to be adjusted vertically simultaneously. After adjusting, the mobile pin 26 is inserted into another one of the holes 25 on the corresponding bar 12*a* and 12*b* and the pin 40 is moved away from the cavity 41.

Figure 4:
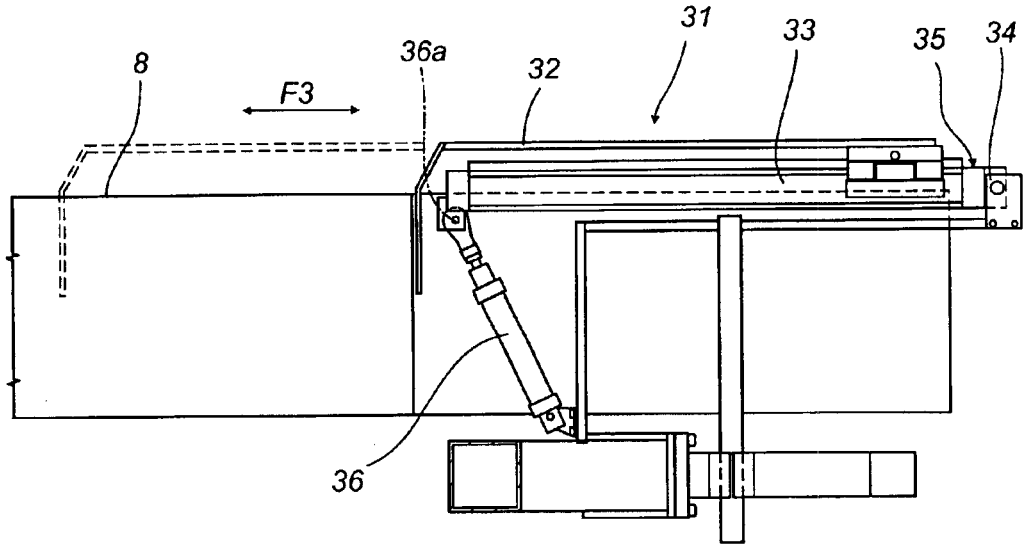
FIGS. 4 and 5 are schematic side views showing a detail C from FIG. 2 in two different working configurations.
Figure 5:
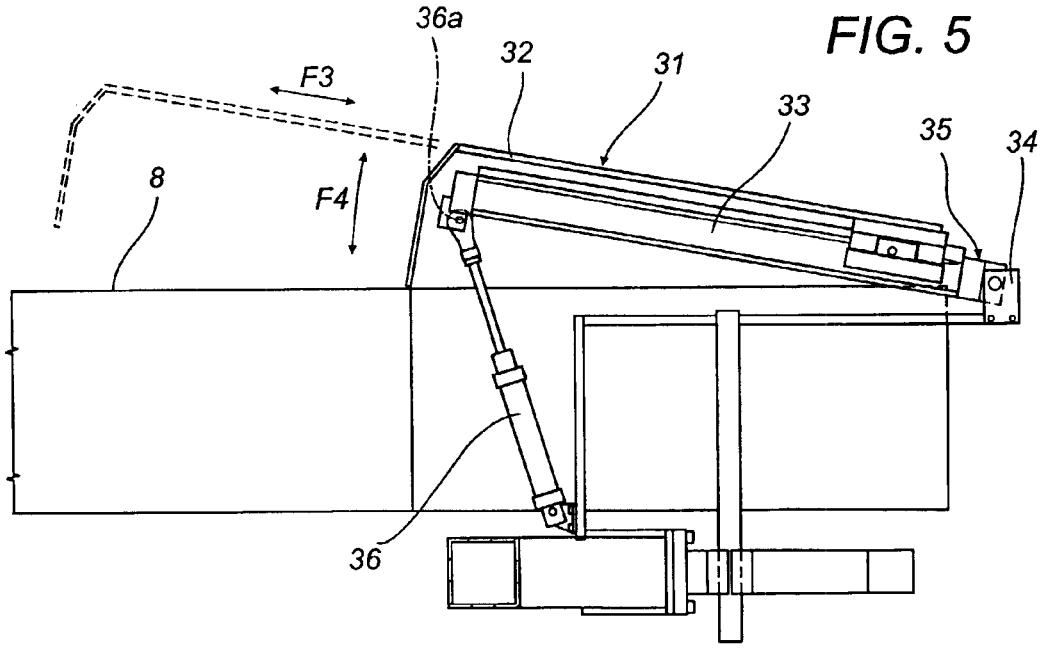

In FIGS. 2, 4 and 5, the numeral 31 denotes means for checking the correct application and hold of at least one of the bands of film 8 and 9.

The means 31 are located just behind one of the uprights 5*a* and 5*b*, and are designed to be inserted between the product stack 4 and the band of film 8 or 9 wrapped around the products, and to then pull the band of film 8 or 9 where the band 8 or 9 itself has been sealed by the respective unit 10 or 11.

As clearly shown in FIGS. 4 and 5, the means 31 for checking the correct application of one of the bands of film 8 or 9 comprise at least one hooked rod 32 that slides on a guide 33 pivoted to a fixed arm 34.

The rod 32 is connected to a first cylinder 35 for driving the rod 32 in a straight line from a retracted idle position (see FIG. 4), where the rod 32 is away from the product stack 4 to a forward working position where the rod 32 is close to the product stack 4, and vice versa (see arrow F3).

A second cylinder 36 is pivoted at point 36*a* and acts on the end of the guide 33 in such a way as to lift the rod 32 (see arrow F4 in FIG. 5) to release it from the area engaged by the band of film 8 or 9 wrapped around the stack 4.

In practice, the rod 32 is moved forward just before the product stack 4 intercepts the bands of film 8 and 9 so that it is close to the pallet 3 when the latter has passed under the gantry structure 5.

When the film has been wrapped and the sealing and cutting units 10 and 11 have been activated, the rod 32 is positioned between the band of film 8 and the product stack 4. Just before the pallet 3 is moved forward, that is to say, while the bars 12*a* and 12*b* are moving back towards the uprights 5*a* and 5*b*, the rod 32 is moved intermittently in the direction of the arrow F3 thus checking whether the band of film 8 is tightly wrapped around the product stack 4.

If the band of film 8 is tightly wrapped, the rod 32 is pushed up by the second cylinder 36 and retracted.

Preferably, the apparatus according to the invention includes two rods 32 for checking the correct application of both of the bands of film 8 and 9 wrapped around the product stack 4. In a preferred embodiment, the rods 32 are positioned at a respective upright 5*a* and 5*b* and at different heights depending on the height of the band of film 8 or 9 to be checked.

An apparatus structured as described above achieves the aforementioned aims thanks to a system of mounting the sealing and cutting units that is extremely, practical and reliable and enables the gantry structure to be adapted to any type of production line.

The incorporation of the two units on a single pair of mounting bars projecting from the gantry structure enables the units to be adjusted more quickly according to the position of the reels and allows cutting and sealing to be performed quickly and easily, thus saving time.

It will be understood that the invention can be subject to modifications and variations without thereby departing from the scope of the inventive concept. Moreover, all the details of the invention may be substituted by technically equivalent elements.

What is claimed is:

1. An apparatus for banding palletized products, the apparatus (1) comprising: a conveyor (2) extending in a direction of feed (A) and used to carry the pallets (3), each supporting a stack (4) of the products; a gantry structure (5) mounted over the conveyor (2) and equipped with two pairs (6, 7) of film reels, each pair being mounted at a different height from the other on gantry uprights (5*a*, 5*b*) in such a way as to form two bands (8, 9) of film positioned transversely relative to the uprights (5*a*, 5*b*) so as to intercept the front of the product stack (4) as it moves forward; a pair of units (10, 11) for sealing and cutting the film bands (8, 9) supported by the gantry structure (5) on the rear side of said gantry structure relative to the direction of feed (A), and mobile between an idle position, where the units (10, 11) are close to the uprights (5*a*, 5*b*), and a working position, where the units (10, 11) are away from the uprights (5*a*, 5*b*) so that each intercepts, seals and cuts a respective portion of the film bands (8, 9) wrapped around the product stack (4); wherein the pair of sealing and cutting units (10, 11) are supported by a single mounting unit (12) that projects from the gantry structure (5) and that slides along the crossbeam (5*c*) to and from the idle and working positions; said mounting unit (12) being equipped with means (13*a*, 13*b*) for locking and stabilizing the units (10, 11) acting on the mounting unit (12) when it is at the working position, and thus forming a rigid system, wherein the mounting unit (12) comprises a pair of vertical bars (12*a*, 12*b*) projecting from the crossbeam (5*c*) and mounting the pair of units (10, 11), each of which is divided into two halves, each of the halves attached to one respective bar (12*a*, 12*b*); each bar (12*a*, 12*b*) being equipped with means (14) for adjusting the position of each of the units (10, 11) lengthwise along the bars according to the positions of the respective reels (6, 7).

2. The apparatus according to claim 1, wherein the means (14) for adjusting the sealing and cutting units (10, 11) along each of the bars (12*a*, 12*b*) comprise a plurality of holes (25) equally spaced on each bar (12*a*, 12*b*) and engaged with a mobile pin (26) presented by each sealing and cutting unit (10, 11).

3. The apparatus according to claim 1, wherein each reel (6, 7), mounted on the respective upright (5*a*, 5*b*), is equipped with rollers (27) for feeding and tensioning the bands of film (8, 9) being unwound.

4. The apparatus according to claim 1, wherein each reel (6, 7) is equipped with a carriage (28) coupled to a power driven shaft (29) forming a worm screw that enables adjustment in both directions along the respective upright (5*a*, 5*b*).

5. The apparatus according to claim 1, wherein between the reels (6, 7) and the respective sealing and cutting unit (10, 11), there are means (30) for synchronizing the movements of the reels (6, 7) with those of the corresponding sealing and cutting units (10, 11) during their adjustment in height when the bars (12*a*, 12*b*) are in the idle position.

6. The apparatus according to claim 1, wherein at least one of the vertical bars (12*a*, 12*b*) is attached to a section of an endless chain (15) supported by the crossbeam (5*c*); the chain (15) being driven by a cylinder (16) that acts on the section of the chain (15) in such a way as to drive the units (10, 11) in both directions; each bar (12*a*, 12*b*) being equipped with a bearing (17) that joins it to a single horizontal worm screw (18) located on the crossbeam (5*c*) in such a way that the cylinder (16) drives the two bars (12*a*, 12*b*) towards and away from each other in synchronized fashion.

7. An apparatus for banding palletized products, the apparatus (1) comprising: a conveyor (2) extending in a direction of feed (A) and used to carry the pallets (3), each supporting a stack (4) of the products; a gantry structure (5) mounted over the conveyor (2) and equipped with two pairs (6, 7) of film reels, each pair being mounted at a different height from the other on gantry uprights (5*a*, 5*b*) in such a way as to form two bands (8, 9) of film positioned transversely relative to the uprights (5*a*, 5*b*) so as to intercept the front of the product stack (4) as it moves forward; a pair of units (10, 11) for sealing and cutting the film bands (8, 9) supported by the gantry structure (5) on the rear side of said gantry structure relative to the direction of feed (A), and mobile between an idle position, where the units (10, 11) are close to the uprights (5*a*, 5*b*), and a working position, where the units (10, 11) are away from the uprights (5*a*, 5*b*) so that each intercepts, seals and cuts a respective portion of the film bands (8, 9) wrapped around the product stack (4); wherein the pair of sealing and cutting units (10, 11) are supported by a single mounting unit (12) that projects from the gantry structure (5) and that slides along the crossbeam (5*c*) to and from the idle and working positions; said mounting unit (12) being equipped with means (13*a*, 13*b*)

for locking and stabilizing the units (10, 11) acting on the mounting unit (12) when it is at the working position, and thus forming a rigid system, wherein the mounting unit (12) comprises a pair of vertical bars (12*a*, 12*b*) projecting from the crossbeam (5*c*) and mounting the pair of units (10, 11) associated with the bars (12*a*, 12*b*); locking means (13*a*, 13*b*) being fitted to act on the ends of the bars (12*a*, 12*b*) to form a rigid system when said bars are in the working position, wherein at least one of the bars (12*a*, 12*b*) is attached to a section of an endless chain (15) supported by the crossbeam (5*c*); the chain (15) being driven by a cylinder (16) that acts on the other section of the chain (15) in such a way as to drive the units (10, 11) in both directions; each bar (12*a*, 12*b*) being equipped with a bearing (17) that joins it to a single horizontal worm screw (18) located on the crossbeam (5*c*) in such a way that the cylinder (16) drives the two bars (12*a*, 12*b*) towards and away from each other in synchronized fashion.

8. The apparatus according to claim 7, wherein each unit (10, 11) is divided into two halves, each attached to one respective bar (12*a*, 12*b*).

9. An apparatus for banding palletized products, the apparatus (1) comprising: a conveyor (2) extending in a direction of feed (A) and used to carry the pallets (3), each supporting a stack (4) of the products; a gantry structure (5) mounted over the conveyor (2) and equipped with two pairs (6, 7) of film reels, each pair being mounted at a different height from the other on gantry uprights (5*a*, 5*b*) in such a way as to form two bands (8, 9) of film positioned transversely relative to the uprights (5*a*, 5*b*) so as to intercept the front of the product stack (4) as it moves forward; a pair of units (10, 11) for sealing and cutting the film bands (8, 9) supported by the gantry structure (5) on the rear side of said gantry structure relative to the direction of feed (A), and mobile between an idle position, where the units (10, 11) are close to the uprights (5*a*, 5*b*), and a working position, where the units (10, 11) are away from the uprights (5*a*, 5*b*) so that each intercepts, seals and cuts a respective portion of the film bands (8, 9) wrapped around the product stack (4); wherein the pair of sealing and cutting units (10, 11) are supported by a single mounting unit (12) that projects from the gantry structure (5) and that slides along the crossbeam (5*c*) to and from the idle and working positions; said mounting unit (12) being equipped with means (13*a*, 13*b*) for locking and stabilizing the units (10, 11) acting on the mounting unit (12) when it is at the working position, and thus forming a rigid system, wherein the mounting unit (12) comprises a pair of vertical bars (12*a*, 12*b*) projecting from the crossbeam (5*c*) and mounting the pair of units (10, 11) associated with the bars (12*a*, 12*b*); locking means (13*a*, 13*b*) being fitted to act on the ends of the bars (12*a*, 12*b*) to form a rigid system when said bars are in the working position, said locking means (13*a*, 13*b*) comprising a pair of bolts (19, 20) each pivoted at the top and bottom ends of one of the bars (12*a*, 12*b*) and driven by a cylinder (21, 22) that drives it between a raised idle position and a lowered working position at which each bolt (19, 20) engages with a corresponding pin (23, 24) located on the bars (12*a*, 12*b*) in such a way as to stabilize the bars along their full length when they are in the working position.

10. An apparatus for banding palletized products, the apparatus (1) comprising: a conveyor (2) extending in a direction of feed (A) and used to carry the pallets (3), each supporting a stack (4) of the products; a gantry structure (5) mounted over the conveyor (2) and equipped with two pairs (6, 7) of film reels, each pair being mounted at a different height from the other on gantry uprights (5*a*, 5*b*) in such a way as to form two bands (8, 9) of film positioned transversely relative to the uprights (5*a*, 5*b*) so as to intercept the front of the product stack (4) as it moves forward; a pair of units (10, 11) for sealing and cutting the film bands (8, 9) supported by the gantry structure (5) on the rear side of said gantry structure relative to the direction of feed (A), and mobile between an idle position, where the units (10, 11) are close to the uprights (5*a*, 5*b*), and a working position, where the units (10, 11) are away from the uprights (5*a*, 5*b*) so that each intercepts, seals and cuts a respective portion of the film bands (8, 9) wrapped around the product stack (4); wherein the pair of sealing and cutting units (10, 11) are supported by a single mounting unit (12) that projects from the gantry structure (5) and that slides along the crossbeam (5*c*) to and from the idle and working positions; said mounting unit (12) being equipped with means (13*a*, 13*b*) for locking and stabilizing the units (10, 11) acting on the mounting unit (12) when it is at the working position, and thus forming a rigid system, said apparatus further comprising means (31) for checking the correct application of at least one of the bands of film (8, 9), located just behind one of the uprights (5*a*, 5*b*), and designed to be inserted between the product stack (4) and the band of film (8, 9) wrapped around the products and to pull the band of film (8, 9) where the band (8, 9) itself has been sealed.

11. The apparatus according to claim 10, wherein the means (31) for checking the correct application of at least one of the bands of film (8, 9) comprise at least one hooked rod (32) that slides on a guide (33) pivoted to a fixed arm, (34); the rod (32) being connected to a first cylinder (35) for driving the rod (32) in a straight line from a retracted idle position, where the rod 32 is away from the product stack (4) to a forward working position where the rod (32) is close to the product stack (4), and vice versa; a second cylinder (36) being pivoted to and acts on the end of the guide (33) in such a way as to lift the rod (32) so as to release it from the area engaged by the band of film (8, 9).

12. The apparatus according to claim 11, wherein the means for checking the correct application of both of the bands of film (8, 9) wrapped around the product stack (4) comprises at least two rods (32); the rods (32) being positioned at a respective upright (5*a*, 5*b*) and at different heights.

* * * * *